US010281099B2

(12) United States Patent
Patton et al.

(10) Patent No.: US 10,281,099 B2
(45) **Date of Patent: *May 7, 2019**

(54) ELECTRIC CANDLE HAVING FLICKERING EFFECT

(71) Applicant: Luminara Worldwide, LLC, Eden Prairie, MN (US)

(72) Inventors: Douglas Patton, Irvine, CA (US); Gary Bordenkicher, Lake Forest, CA (US)

(73) Assignee: Luminara Worldwide, LLC, Eden Prairie, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/653,481

(22) Filed: Jul. 18, 2017

(65) Prior Publication Data

US 2018/0187848 A1 Jul. 5, 2018

Related U.S. Application Data

(63) Continuation of application No. 15/298,713, filed on Oct. 20, 2016, now Pat. No. 9,709,230.

(Continued)

(51) Int. Cl.
*F21V 1/00* (2006.01)
*F21S 10/04* (2006.01)

(Continued)

(52) U.S. Cl.
CPC ..... *F21S 10/046* (2013.01); *F21S 6/001* (2013.01); *F21S 9/02* (2013.01); *F21V 11/08* (2013.01);

(Continued)

(58) Field of Classification Search
CPC . F21V 11/08; F21V 3/02; F21S 10/046; F21S 9/02; F21S 6/001; F21W 2121/00

(Continued)

(56) References Cited

U.S. PATENT DOCUMENTS 4,617,614 A 10/1986 Lederer
5,174,645 A * 12/1992 Chung ..... F21S 6/001 362/392

(Continued)

FOREIGN PATENT DOCUMENTS

CA 2647987 A1 10/2001
CA 2772728 A1 4/2010

(Continued)

OTHER PUBLICATIONS

International Search Report and Written Opinion for PCT Application No. PCT/US16/57906, Patent Cooperation Treaty, KIPO, dated Mar. 10, 2017.

(Continued)

*Primary Examiner* — Ali Alavi
(74) *Attorney, Agent, or Firm* — Umberg Zipser LLP

(57) ABSTRACT

Various designs of electronic lighting devices are disclosed. Contemplated electronic lighting devices comprise a housing, a base, and a light source holder. The housing comprises an internal cavity that typically houses the base and the light source holder. The base is configured to mate with the housing, and the light source holder is affixed to the base. Preferably, the light source holder is configured to receive a light source in an inclined position with respect to the housing, such that light from the light source is emitted through an aperture of the housing and onto a flame element to simulate a real candle light.

23 Claims, 11 Drawing Sheets

Related U.S. Application Data

(60) Provisional application No. 62/267,168, filed on Dec. 14, 2015.

(51) Int. Cl.

| | |
|---|---|
| ***F21S 6/00*** | (2006.01) |
| ***F21S 9/02*** | (2006.01) |
| ***F21V 11/08*** | (2006.01) |
| ***F21V 23/04*** | (2006.01) |
| *F21V 3/02* | (2006.01) |
| *F21W 121/00* | (2006.01) |
| *F21Y 115/10* | (2016.01) |

(52) U.S. Cl.
CPC ..... *F21V 23/04* (2013.01); *F21V 3/02* (2013.01); *F21W 2121/00* (2013.01); *F21Y 2115/10* (2016.08)

(58) Field of Classification Search
USPC ..... 362/235
See application file for complete search history.

(56) References Cited

U.S. PATENT DOCUMENTS

| | | | | |
|---|---|---|---|---|
| 5,924,784 | A | 7/1999 | Chliwnyj et al. | |
| 6,017,139 | A * | 1/2000 | Lederer | F21S 6/001 200/51.01 |
| 6,312,137 | B1 | 11/2001 | Hsieh | |
| 6,688,752 | B2 | 2/2004 | Moore | |
| 7,159,994 | B2 | 1/2007 | Schnuckle et al. | |
| 7,261,455 | B2 | 8/2007 | Schnuckle et al. | |
| 7,350,720 | B2 | 4/2008 | Jaworski et al. | |
| 7,481,571 | B2 | 1/2009 | Bistritzky et al. | |
| 7,503,668 | B2 | 3/2009 | Porchia et al. | |
| 7,686,471 | B2 | 3/2010 | Reichow | |
| 7,824,627 | B2 * | 11/2010 | Michaels | A01M 1/205 239/102.2 |
| 7,837,355 | B2 | 11/2010 | Schnuckle | |
| 8,070,319 | B2 * | 12/2011 | Schnuckle | F21S 10/04 362/249.02 |
| 8,132,936 | B2 | 3/2012 | Patton et al. | |
| 8,342,712 | B2 | 1/2013 | Patton et al. | |
| 8,534,869 | B2 | 9/2013 | Patton et al. | |
| 8,550,660 | B2 | 10/2013 | Patton et al. | |
| 8,646,946 | B2 | 2/2014 | Schnuckle et al. | |
| 8,696,166 | B2 | 4/2014 | Patton et al. | |
| 8,721,118 | B2 | 5/2014 | Patton et al. | |
| 8,727,569 | B2 | 5/2014 | Schnuckle et al. | |
| 8,777,465 | B2 | 7/2014 | Patton et al. | |
| 8,789,986 | B2 | 7/2014 | Li | |
| 8,820,962 | B2 | 9/2014 | Kang | |
| 8,926,137 | B2 | 1/2015 | Li | |
| 9,052,078 | B2 | 6/2015 | Sheng | |
| 9,068,706 | B2 * | 6/2015 | Fournier | F21L 4/00 |
| 9,074,759 | B2 | 7/2015 | Lai | |
| 9,133,992 | B2 | 9/2015 | Lee | |
| 9,366,402 | B2 * | 6/2016 | Li | F21S 6/001 |
| 9,371,973 | B2 * | 6/2016 | Li | F21S 10/046 |
| 9,709,230 | B2 * | 7/2017 | Patton | F21S 6/001 |
| 9,739,432 | B2 * | 8/2017 | Li | F21S 6/001 |
| 9,810,388 | B1 * | 11/2017 | Li | F21S 6/001 |
| 2004/0165374 | A1 | 8/2004 | Robinson | |
| 2005/0169666 | A1 | 8/2005 | Porchia et al. | |
| 2005/0285538 | A1 | 12/2005 | Jaworski et al. | |
| 2006/0034079 | A1 | 2/2006 | Schnuckle et al. | |
| 2006/0034100 | A1 | 2/2006 | Schnuckle et al. | |
| 2006/0039835 | A1 | 2/2006 | Nottingham et al. | |
| 2006/0125420 | A1 | 6/2006 | Boone et al. | |
| 2006/0146544 | A1 | 7/2006 | Leung | |
| 2007/0127249 | A1 | 6/2007 | Medley et al. | |
| 2008/0031784 | A1 | 2/2008 | Bistritzky et al. | |
| 2008/0038156 | A1 | 2/2008 | Jaramillo | |
| 2008/0117633 | A1 | 5/2008 | Li | |
| 2008/0130266 | A1 | 6/2008 | DeWitt et al. | |
| 2008/0150453 | A1 | 6/2008 | Medley et al. | |
| 2011/0027124 | A1 | 2/2011 | Albee et al. | |
| 2011/0110073 | A1 | 5/2011 | Schnuckle et al. | |
| 2011/0127914 | A1 | 6/2011 | Patton et al. | |
| 2011/0134628 | A1 | 6/2011 | Pestl et al. | |
| 2011/0317403 | A1 | 12/2011 | Fournier et al. | |
| 2012/0020052 | A1 | 1/2012 | McCavit et al. | |
| 2012/0024837 | A1 | 2/2012 | Thompson | |
| 2012/0093491 | A1 | 4/2012 | Browder et al. | |
| 2012/0134157 | A1 | 5/2012 | Li | |
| 2013/0050985 | A1 | 2/2013 | Kwok et al. | |
| 2013/0148353 | A1 | 6/2013 | Patton et al. | |
| 2013/0258648 | A1 | 10/2013 | Ding | |
| 2013/0286642 | A1 | 10/2013 | Patton | |
| 2014/0104812 | A1 | 4/2014 | Patton et al. | |
| 2014/0140534 | A1 | 5/2014 | Gutstein et al. | |
| 2014/0177212 | A1 | 6/2014 | Li | |
| 2014/0218903 | A1 | 8/2014 | Sheng | |
| 2014/0218929 | A1 | 8/2014 | Schnuckle et al. | |
| 2014/0241004 | A1 | 8/2014 | Chen | |
| 2014/0254148 | A1 | 9/2014 | Fournier et al. | |
| 2015/0036348 | A1 | 2/2015 | Dong | |
| 2015/0055331 | A1 | 2/2015 | Lai | |
| 2015/0109786 | A1 | 4/2015 | Li | |
| 2015/0124442 | A1 | 5/2015 | Ding | |
| 2015/0204530 | A1 | 7/2015 | Lee | |
| 2015/0233538 | A1 | 8/2015 | Sheng | |
| 2015/0285453 | A1 | 10/2015 | Schnuckle et al. | |
| 2015/0292698 | A1 | 10/2015 | Schnuckle et al. | |
| 2015/0308643 | A1 | 10/2015 | Huang | |
| 2015/0362141 | A1 | 12/2015 | Chen | |
| 2015/0369432 | A1 | 12/2015 | Li | |
| 2016/0047517 | A1 | 2/2016 | Li | |
| 2016/0109082 | A1 | 4/2016 | Li et al. | |
| 2016/0109083 | A1 | 4/2016 | Li | |
| 2016/0298816 | A1 | 10/2016 | Fang | |

FOREIGN PATENT DOCUMENTS

| | | | |
|---|---|---|---|
| CA | 2779978 | A1 | 1/2012 |
| CA | 2886665 | | 1/2012 |
| CN | 2888274 | Y | 4/2007 |
| CN | 200940808 | Y | 8/2007 |
| CN | 201011621Y | Y | 1/2008 |
| CN | 201724143 | U | 1/2011 |
| CN | 102147095 | B | 8/2011 |
| CN | 202032445 | U | 11/2011 |
| CN | 202188437 | U | 4/2012 |
| CN | 202215951 | U | 5/2012 |
| CN | 102563510 | A | 7/2012 |
| CN | 101865413 | B | 8/2012 |
| CN | 101918755 | B | 8/2012 |
| CN | 102734740 | A | 10/2012 |
| CN | 102748589 | A | 10/2012 |
| CN | 20270896 | U | 1/2013 |
| CN | 202647570 | U | 1/2013 |
| CN | 202708605 | U | 1/2013 |
| CN | 202747231 | U | 2/2013 |
| CN | 102352966 | B | 4/2013 |
| CN | 103047604 | A | 4/2013 |
| CN | 103196094 | A | 7/2013 |
| CN | 203115826 | U | 8/2013 |
| CN | 203147617 | U | 8/2013 |
| CN | 203273669 | U | 11/2013 |
| CN | 103471028 | A | 12/2013 |
| CN | 203375334 | U | 1/2014 |
| CN | 102721002 | B | 2/2014 |
| CN | 203442498 | U | 2/2014 |
| CN | 203464042 | U | 3/2014 |
| CN | 203571616 | U | 4/2014 |
| DE | 202012102347 | U | 7/2012 |
| DE | 202014100821 | U | 3/2014 |
| EP | 1869360 | B1 | 11/2011 |
| EP | 2232128 | B1 | 1/2013 |
| EP | 2546571 | A1 | 1/2013 |
| EP | 2565518 | A1 | 3/2013 |
| EP | 2587127 | A1 | 5/2013 |
| EP | 2644970 | A1 | 10/2013 |
| GB | 2323159 | A | 9/1998 |

(56) References Cited

FOREIGN PATENT DOCUMENTS

| | | | |
|---|---|---|---|
| GB | 2379731 | A | 3/2003 |
| WO | 82/02756 | A1 | 8/1982 |
| WO | 87/04506 | A1 | 7/1987 |
| WO | 96/25624 | A1 | 8/1996 |
| WO | 01/92780 | A1 | 12/2001 |
| WO | 2006/020839 | A2 | 2/2006 |
| WO | 2012/000418 | A1 | 1/2012 |
| WO | 2013/189187 | A1 | 12/2013 |
| WO | 2014/036968 | A1 | 3/2014 |
| WO | 2014/169809 | A1 | 10/2014 |
| WO | 2015/021066 | A2 | 2/2015 |
| WO | 2015/080664 | A1 | 6/2015 |
| WO | 2015/139399 | A1 | 9/2015 |

OTHER PUBLICATIONS

International Search Report and Written Opinion for Application No. PCT/US2016/057906, dated Mar. 10, 2017; 12 pgs.

* cited by examiner

FIG. 1C
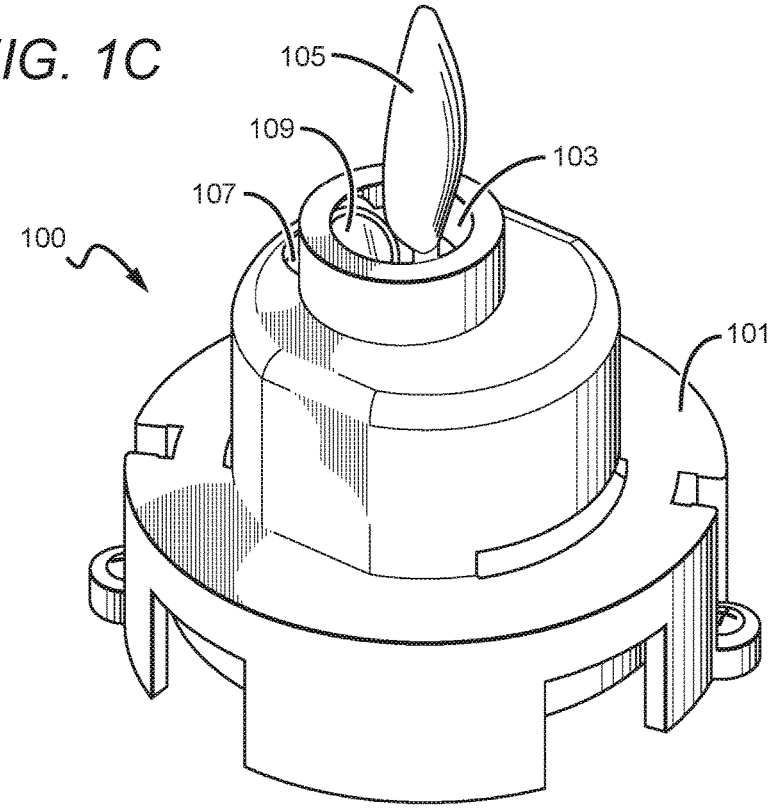
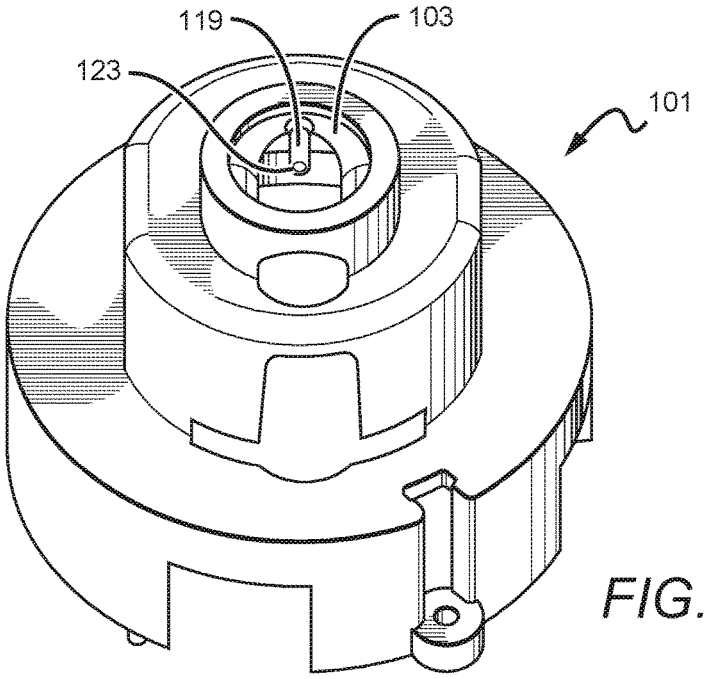
FIG. 1F 200
205
203
201
209
211
207
213
221

FIG. 2G
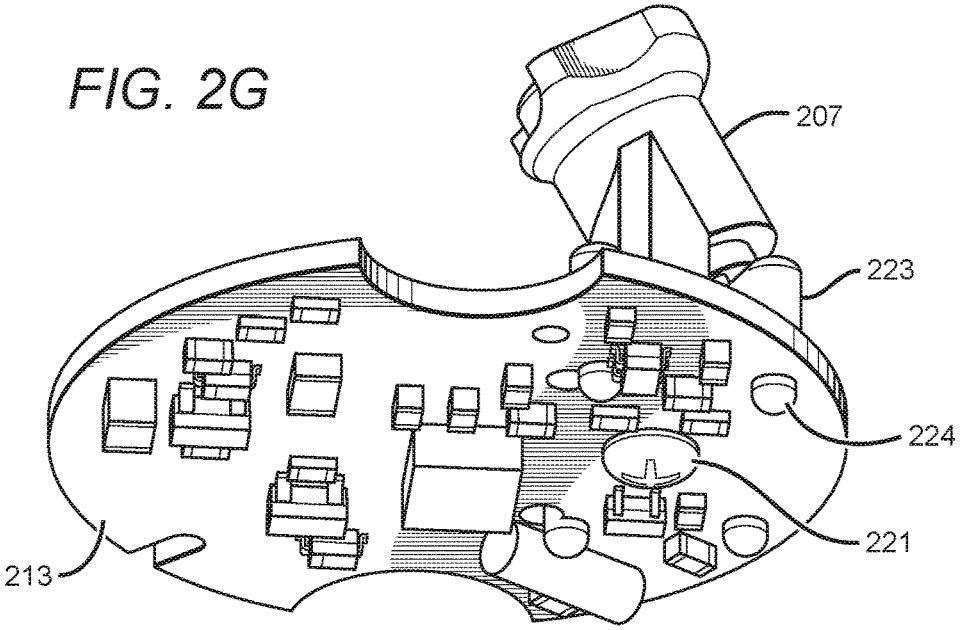
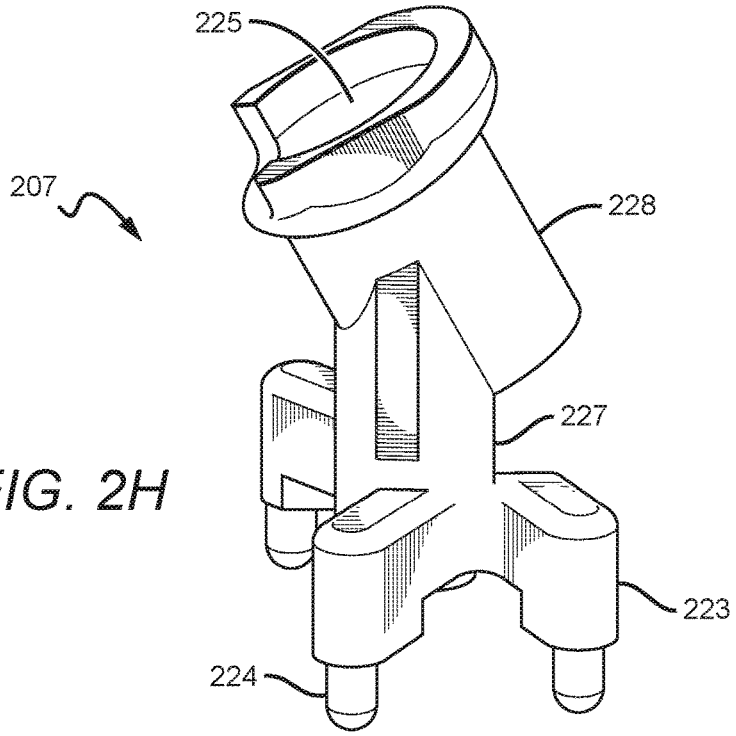
FIG. 2H

FIG. 2I
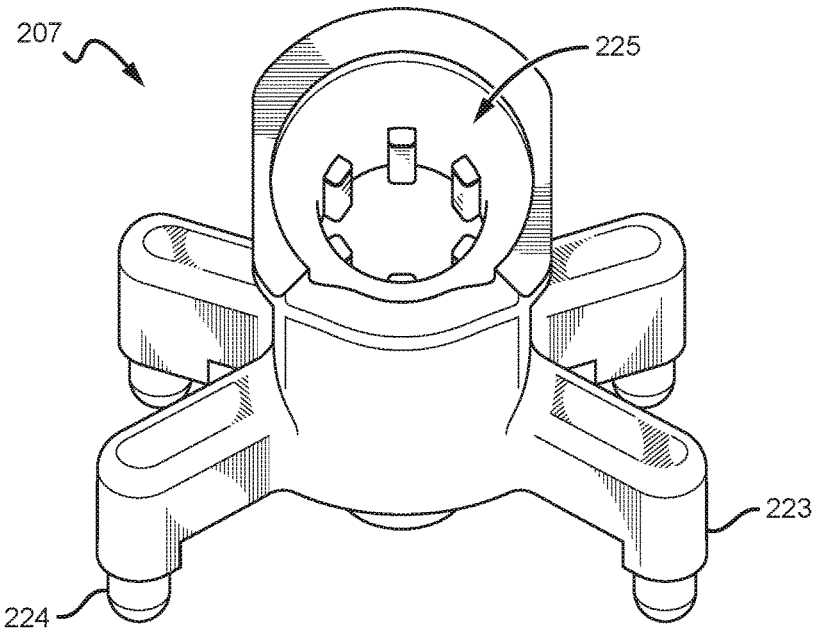
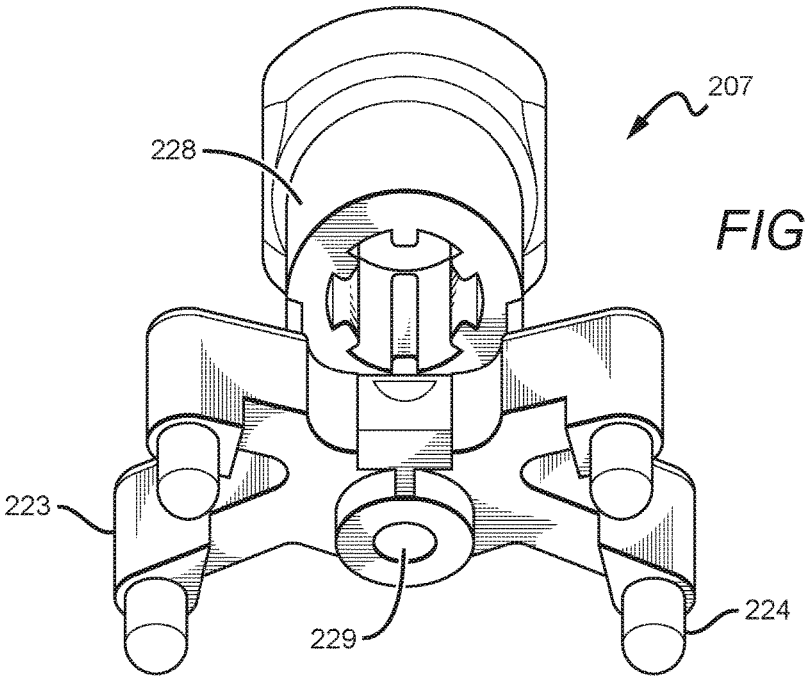
FIG. 2J

ELECTRIC CANDLE HAVING FLICKERING EFFECT

This application is a continuation of U.S. patent application Ser. No. 15/298,713, filed Oct. 20, 2016, and claims the benefit of priority of U.S. Provisional Application No. 62/267,168, filed Dec. 14, 2015. All extrinsic materials identified herein are incorporated by reference in their entirety.

FIELD OF THE INVENTION

The field of the invention is electronic lighting devices, and in particular, electric candles.

BACKGROUND

The background description includes information that may be useful in understanding the present invention. It is not an admission that any of the information provided herein is prior art or relevant to the presently claimed invention, or that any publication specifically or implicitly referenced is prior art.

These and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

Various electric lighting devices are known in the art. For example, the following is a list of lighting devices: U.S. Pat. No. 8,132,936 to Patton et al., U.S. Pat. No. 8,070,319 to Schnuckle et al., U.S. Pat. No. 7,837,355 to Schnuckle et al., U.S. Pat. No. 7,261,455 to Schnuckle et al., U.S. Pat. No. 7,159,994 to Schnuckle et al., US 2011/0127914 to Patton et al., U.S. Pat. No. 7,350,720 to Jaworski et al.; US 2005/0285538 to Jaworski et al. (publ. December 2005); U.S. Pat. No. 7,481,571 to Bistritzky et al.; US 2008/0031784 to Bistritzky et al. (publ. February 2008); US 2006/0125420 to Boone et al. (publ. June 2006); US 2007/0127249 to Medley et al. (publ. June 2007); US 2008/0150453 to Medley et al. (publ. June 2008); US 2005/0169666 to Porchia, et al. (publ. August 2005); U.S. Pat. No. 7,503,668 to Porchia, et al.; U.S. Pat. No. 7,824,627 to Michaels, et al.; US 2006/0039835 to Nottingham et al. (publ. February 2006); US 2008/0038156 to Jaramillo (publ. February 2008); US 2008/0130266 to DeWitt et al. (publ. June 2008); US 2012/0024837 to Thompson (publ. February 2012); US 2011/0134628 to Pestl et al. (publ. June 2011); US 2011/0027124 to Albee et al. (publ. February 2011); US 2012/0020052 to McCavit et al. (publ. January 2012); US 2012/0093491 to Browder et al. (publ. April 2012); and US 2014/0218903 to Sheng.

Although these lighting devices may present advantages over prior devices, there is still a need in the art for improved electric candles and other lighting devices.

SUMMARY OF THE INVENTION

The inventive subject matter provides apparatus, systems, and methods in which a real candle flame can be effectively simulated using multiple configurations of components to thereby create electronic lighting devices (e.g., artificial candles). In one aspect, an electric lighting device comprises a housing, a base, and a light source holder. The housing comprises an internal cavity and an aperture on an upper surface. The base is configured to mate with the housing to enclose the internal cavity. The light source holder is disposed within the internal cavity when the housing and base are coupled, and may be affixed to the base or other component such as a PCB. Preferably, the light source holder is configured to receive a light source (e.g., light-emitting diode) in an inclined position with respect to the housing, such that light from the light source is emitted through the aperture and onto a flame element to help simulate a real candle light.

In some embodiments, the light source holder comprises an elongated stem having a first end and a second end. An elongated, inclined cylinder is disposed on the first end, and the cylinder comprises a first aperture sized and dimensioned to receive the light source. At least three legs extend outwardly near the second end of the elongated stem, with each of the legs having a downwardly extending peg at a distal end. Typically, the base comprises a printed circuit board ("PCB"), having a first surface with at least three apertures, and each of the pegs can extend partially through the apertures when the light source holder is affixed to the PCB. It is contemplated that the light source holder can be affixed to the PCB.

The light source holder comprises an opening disposed on a second end of the elongated stem, and the opening is configured to receive a fastener. The first surface of the base can comprise a second opening, such that insertion of the fastener through the second opening and into the opening affixes the light source holder to the first surface of the base. Thus, the light source holder can be securely mounted to the first surface of the base using the legs/pegs and the fastener.

In some embodiments, the light source holder comprises an elongated stem that extends vertically from a base of the light source holder. An elongated, inclined cylinder can be disposed on the elongated stem whereby the cylinder has a first aperture sized and dimensioned to receive the light source. An opening is disposed on the base and the opening is sized and dimensioned to receive a fastener. The light source holder can be affixed to a first surface of the base by inserting a fastener through a second opening on the first surface and the opening on the base of the light source holder.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWINGS

FIG. 1C is a perspective view of the housing, light source holder, flame element and other components of the electronic lighting device of FIG. 1A.

FIG. 1F is a top perspective view of the housing of the electronic lighting device of FIG. 1A.

FIG. 2G is a bottom perspective view of the light source holder and base of FIG. 2F.

FIG. 2H is a perspective view of the light source holder of the electronic lighting device of FIG. 2A.

FIG. 2I is top perspective view of the light source holder of FIG. 2H.

FIG. 2J is a bottom perspective view of the light source holder of FIG. 2H.

DETAILED DESCRIPTION

The following discussion provides example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

Also, as used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

The inventor has discovered that electronic lighting devices can be produced using various designs without reducing the ability to simulate a real candle light. Specifically, a light source can be effectively mounted within an electronic lighting device to emit light onto a flame element to mimic a real candle light. Indeed, it should be appreciated that various mounting techniques for a light source that do not sacrifice the ability to mimic a real candle light are contemplated. Advantageously, any possible drawbacks from other mounting techniques for a light source can be reduced or even eliminated by the disclosed subject matter. Thus, one should appreciate that the disclosed subject matter provides many beneficial technical effects including providing various designs of an artificial candle that simulate a real candle light.

Figure 1B:
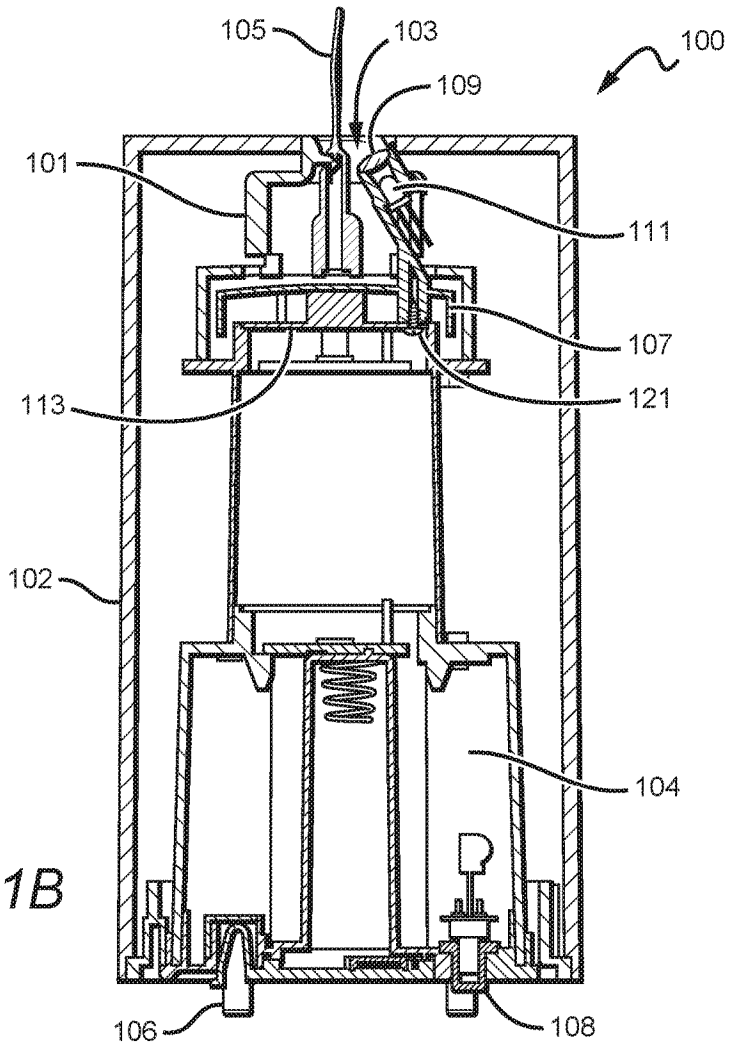
FIG. 1B is a cross-sectional view of the electronic lighting device of FIG. 1A.
Figure 1A:
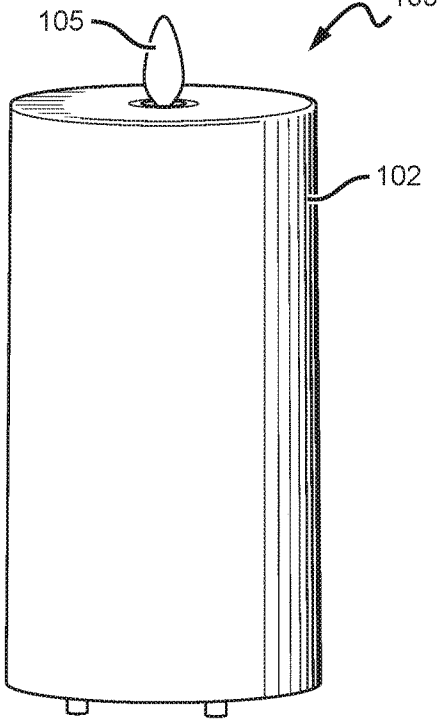
FIG. 1A is a perspective view of an embodiment of an electronic lighting device.

FIG. 1A shows an embodiment of an electronic lighting device 100 having an outer cover 102. A flame element 105 extends from a top of electronic lighting device 100, and is allowed to move in a manner that simulates a moving flame of a real candle. Flame element 105 is partially housed within a housing 101 and preferably extends through an aperture 103 on an upper surface of housing 101 as shown in FIG. 1B.

Flame element 105 can be suspended using a variety of means without sacrificing the ability to mimic a real candle light. For example, flame element 105 can be mounted on a support member (e.g., an arm, wire, etc.) of the housing. In another example, flame element 105 can have a clip configured to couple with a mounting rod. Indeed, it should be appreciated that the support structures for suspending flame element 105 are hidden, such that they are not readily visible to users and do not cast a shadow on flame element 105 by light emitted from a light source 111 of electronic lighting device 100.

As discussed above, flame element 105 is preferably allowed to move in a manner that simulates a moving flame. For example, a circuit board can control a drive mechanism, which could be an electromagnet, a fan, or other component that causes movement of flame element 105 to simulate a moving flame. A detailed description of a flame element and a housing of an electronic lighting device can be found in U.S. patent application Ser. No. 14/819,146 and PCT International Application No. PCT/US2015/011642, which are hereby incorporated by reference.

Flame element 105 typically comprises a hollow interior and an aperture disposed on a sidewall of the flame element 105, but in other embodiments could comprise a through hole extending from one side to the other of the flame element 105. In some embodiments, the support member extends outwardly toward and into the aperture to suspend the flame element within the internal cavity. It is preferred but not required that the flame element has a projection that extends downward into a recess of the support member to allow movement of the flame element while the projection rests within the recess. It is also contemplated that the support member comprises a rigid wire that extends through a through hole in the flame element to suspend the flame element.

Electronic lighting device 100 further comprises a light source holder 107 that is affixed to a base 113, which is typically a PCB. Light source holder 107 is configured to receive one or more light sources 111 and a lens 109 in an inclined position with respect to housing 101, such that light from light source 111 is emitted onto flame element 105. It is contemplated that light source 111 can comprise a light-emitting diode (LED) or other light-emitting device. Light source holder 107 and base 113 can be affixed by one or more fasteners 121.

Lens 109 can be used to focus light emitted from light source 111 on to specific areas of the flame element 105, for example. It is contemplated that light source 111 can project different colors of light, though preferably it projects a color that is similar to the color of a candle flame (e.g., orange, yellow, red, blue, or some combination thereof). Lens 109 can be used to focus the light to a desired degree. For example, a focal length greater than the distance between lens 109 and flame element 105 can provide softer lighting than if the light were focused directly onto the flame element. Alternatively, the focal length can be shorter than the distance between lens 109 and flame element 105 to achieve substantially the same effect since with a simple lighting device (e.g., an LED) the orientation of the image is irrelevant.

A battery compartment 104 may be disposed within electronic lighting device 100 to receive a power source (e.g., a disposable battery, a rechargeable battery). In other contemplated embodiments, electronic lighting device 100 can receive power from an external power source. An on/off switch 108 located on a bottom end of electronic lighting device 100 can be used to control the supply of power throughout electronic lighting device 100. The bottom end of electronic lighting device 100 also comprises at least one leg 106 that can be used to provide a space between a bottom surface of electronic lighting device 100 and a surface on which electronic lighting device 100 rests.

Figure 1D:
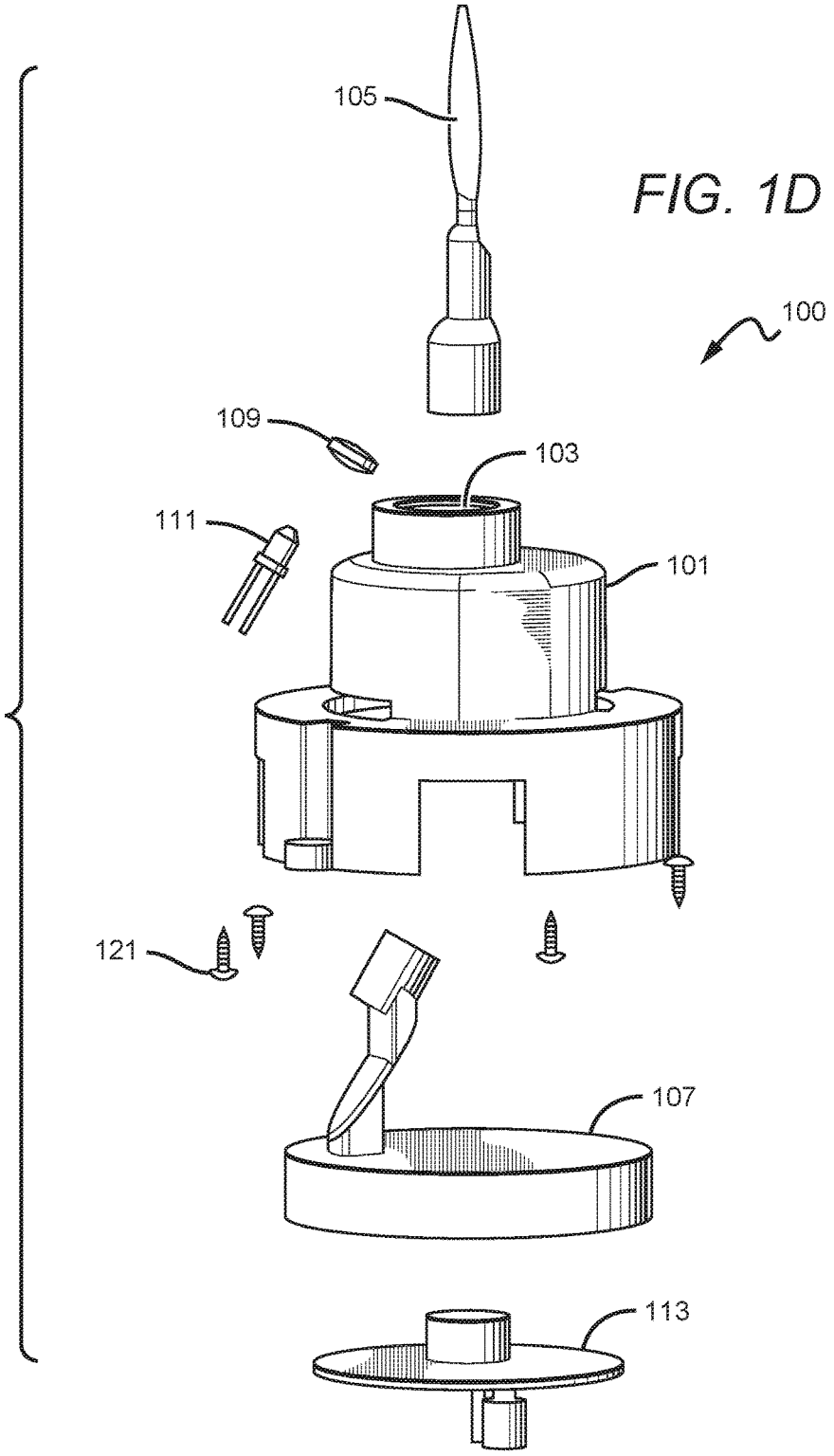
FIG. 1D is an exploded view of the housing, light source holder, flame element and other components of FIG. 1C.
Figure 1E:
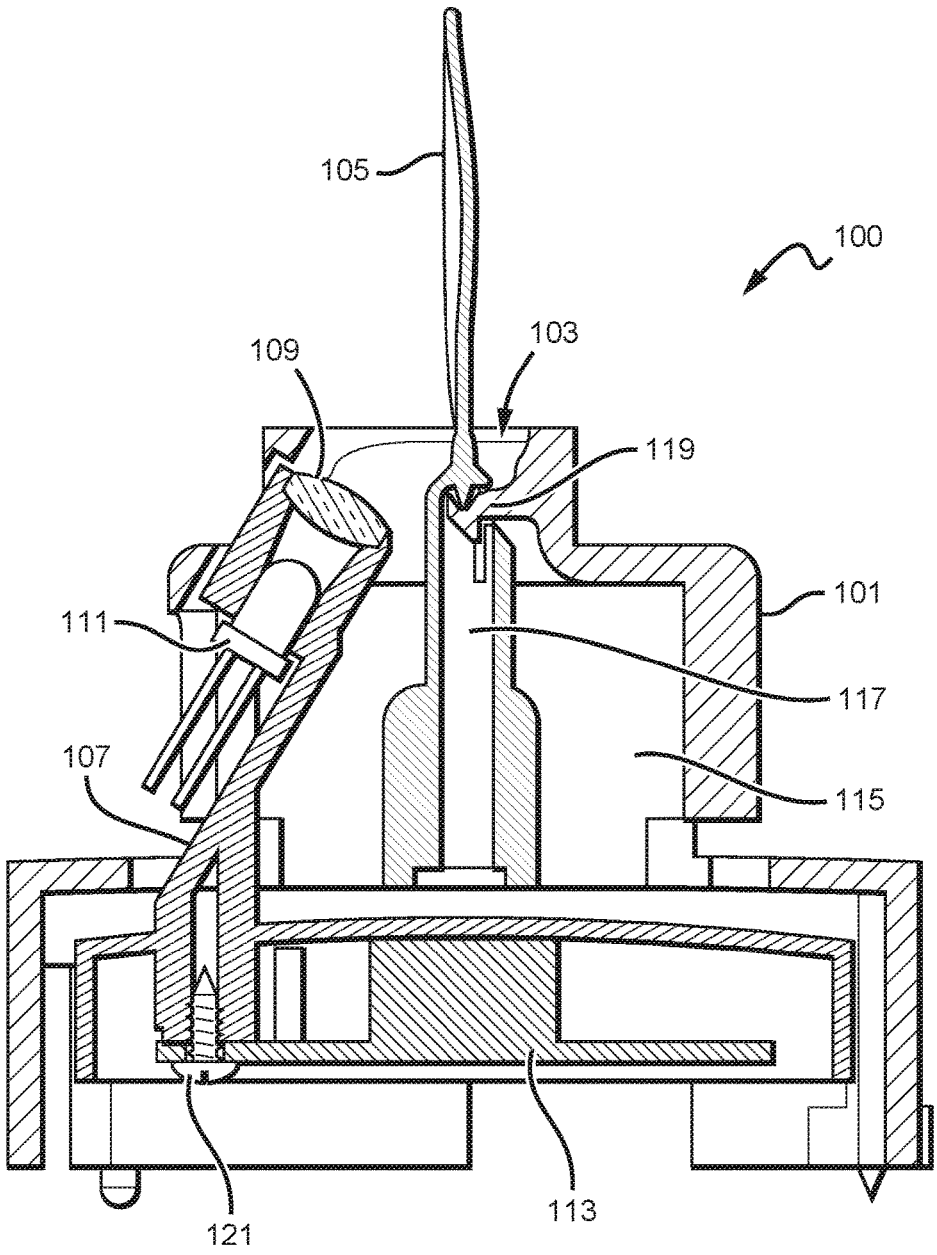
FIG. 1E is a cross-sectional view of the housing, light source holder, flame element and other components of FIG. 1C.

Additional views of housing 101, flame element 105 and light source holder 107 are shown in FIGS. 1C-1E. Housing 101 comprises an internal cavity 115 and an aperture 103 on an upper surface. Base 113 is configured to mate with housing 101, such that housing covers base 113 when housing 101 and base 113 are mated. It is also contemplated that only a portion of base 113 is covered when housing 101 and base 113 are mated. Light source holder 107 is preferably affixed to base 113, such that light source holder 107 is disposed within internal cavity 115 when housing 101 and base 113 are coupled. As shown in FIGS. 1C and 1E, light source holder 107 is configured to receive light source 111 in an inclined position with respect to housing 101, such that light from light source 111 is emitted through aperture 103 and onto flame element 105 to mimic a real candle light.

As discussed above, flame element 105 is supported within housing 101. It is contemplated that flame element 105 is at least partially disposed within internal cavity 115. In some embodiments, flame element 105 can comprise a hollow interior 117 and an aperture on a sidewall. A support member 119 can extend outwardly from housing 101 towards and into the aperture of flame element 105. It is contemplated that support member 119 is sized and dimensioned to extend into the aperture of flame element 105 and rest within hollow interior 117 of flame element 105 to suspend flame element 105 and allow for movement of flame element 105 with respect to support member 119 to mimic movement of a real candle light. In other embodiments, flame element 105 can comprise a downward projection on an apex of hollow interior 117 that is sized and dimensioned to rest on a recess of support member 119 to support flame element 105 on support member 119.

It is also contemplated that support member 119 can be removably coupled with housing 101 to support flame element 105. In other embodiments, flame element 105 can comprise a through hole and support member 119 can extend into the through hole. For example, it is contemplated that support member 119 comprises a rigid wire that extends through the through hole of flame element 105. The rigid wire can be coupled to opposite walls within housing 101, such that the rigid wire extends from one wall to an opposite wall of housing 101.

Base 113 can comprise a PCB. In such embodiments, light source holder 107 can be affixed to the PCB, and preferably affixed to the PCB in an inclined position. It should be appreciated that the PCB can be used to control various functions in electronic lighting device 100, including, but not limited to, movement of flame element 105, powering of light source 211, manipulating color of light source 211, and so forth.

As shown in FIG. 1E, light source holder 107 extends above base 113 and the PCB. Light source holder 107 is sized and dimensioned to receive light source 111 and lens 109 to maintain a predefined focal length between lens 109 and light source 111 when light source holder 107 is affixed to base 113 and the PCB.

Light source holder 107 is affixed to base 113 preferably using fastener 121. Fastener 121 can comprise many suitable fasteners, such as a screw, a nail or a bolt. It is contemplated that light source holder 107 can be affixed to base 113 by other coupling techniques, including, but not limited to, snap-fit, pressure-fit, lock-fit, rotational lock-fitting, rotational snap-fitting, or it can be secured by another piece or pieces dedicated to hold light source holder 107 onto base 113. It should be appreciated that light source holder 107 can be disposed within electronic lighting device 100, such that light source holder 107 is not supported in any way by housing 101 or flame element 105. In other words, in some embodiments, light source holder 107 is not directly coupled with housing 101 or flame element 105.

Housing 101 typically has a cylindrical shape as shown in FIG. 1F. It is contemplated that housing 101 can have two portions with different diameters, although a housing with a single diameter or three or more diameters is also contemplated. For example, a top portion can have a first diameter that is smaller than a second diameter of a bottom portion as shown in FIG. 1F. However, it is contemplated that housing 101 can have a uniform diameter or could be a completely different shape (e.g., square, triangular, rectangular, etc.). Aperture 103 is disposed on a top surface of housing 101. Housing 101 also comprises a support member 119 that extends toward the center of housing 101. In contemplated embodiments, support member 119 comprises a recess 123 that can receive a downward projection of flame element 105 to suspend flame element 105.

Figure 1G:
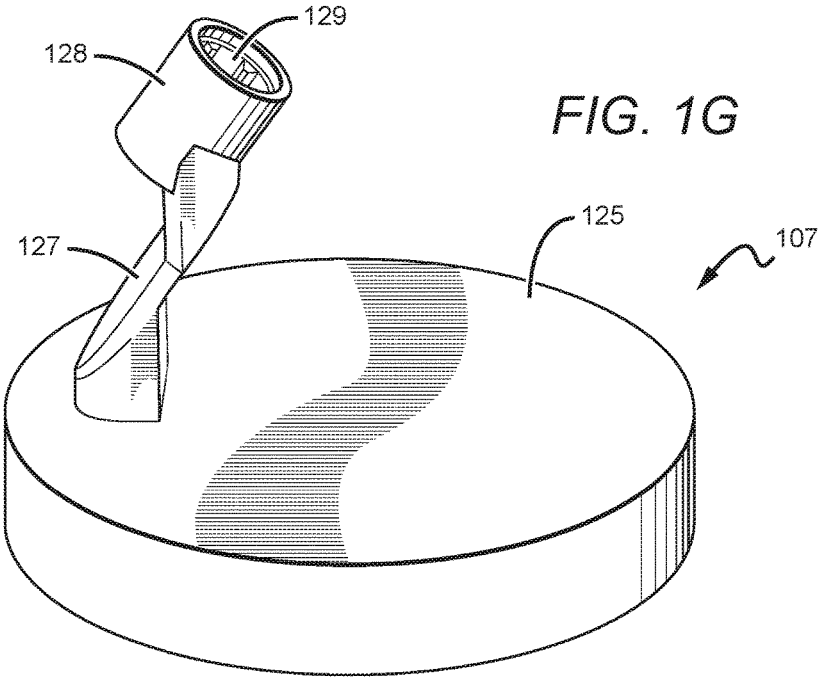
FIG. 1G is a perspective view of the light source holder of the electronic lighting device of FIG. 1A.
Figure 1H:
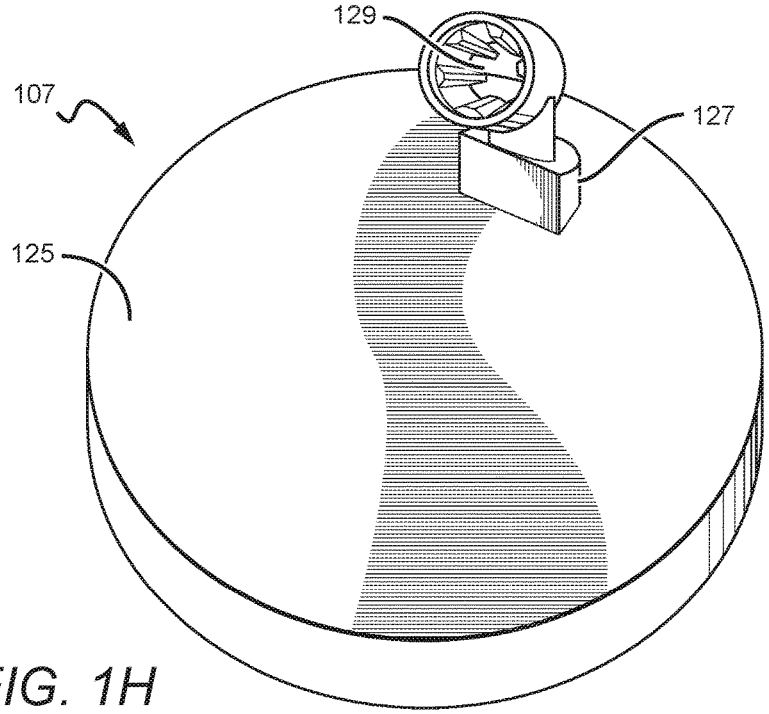
FIG. 1H is a top perspective view of the light source holder of FIG. 1G.
Figure 1I:
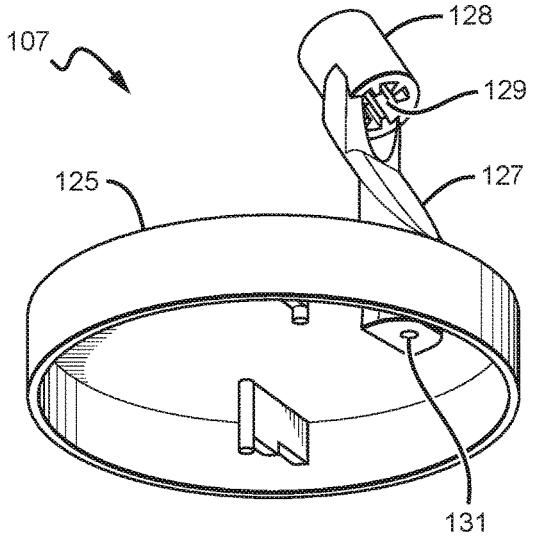
FIG. 1I is a bottom perspective view of the light source holder of FIG. 1G.

Light source holder 107 comprises a base 125 and an elongated stem 127 as shown in FIGS. 1G-1I. The base 125 of light source holder 107 may have a cylindrical shape and be configured to sit atop of a PCB, for example, to help protect the PCB 113 from inadvertent damage by water or other causes (see FIG. 1E where PCB 113 is disposed within bottom surface of base 125 of light source holder 107). In other contemplated embodiments, base 125 of light source holder can be a different shape, including, but not limited to, a square, a rectangle, a triangle, and any other geometric shape. In still further contemplated embodiments, base could comprise one or more legs, and preferably three or more legs extending outwardly from stem 127. An example of this is shown in FIG. 2F.

Elongated stem 127 extends vertically from a top surface of base 125 of light source holder 107. Typically, elongated stem 127 extends proximal to an edge of the top surface of base 125 to provide space for flame element 105 when light source holder 107 is disposed within housing 101. However, in other embodiments, elongated stem 127 can extend from an area closer to the center of the top surface of base 125 of light source holder 107.

As shown in FIG. 1G, elongated stem 127 extends at an angle relative to the top surface of base 125 of light source holder 107. It is contemplated that the angle between elongated stem 127 and the top surface of base 125 is between 30 and 90 degrees, and more typically, between 60 and 90 degrees. It should be appreciated that the angle at which elongated stem 127 extends relative to the top surface of base 125 accommodates the shape of housing 101 so that light source holder 107 is substantially, or completely, disposed within housing 101.

An elongated, inclined cylinder 128 is disposed on an end of elongated stem 127 that is opposite of the top surface of base 125. Inclined cylinder 128 comprises a first aperture 129 sized and dimensioned to receive light source 111 and lens 109. It is contemplated that first aperture 129 can be formed using other structural shapes. Inclined cylinder 128 is also angled relative to the top surface of base 125 to align light source 111 and lens 109 within first aperture 129 with flame element 105 (see FIG. 1E).

A bottom surface of base 125 of light source holder 107 comprises an opening 131. It is contemplated that opening 131 is sized and dimensioned to receive fastener 121. For example, if fastener 121 is a threaded fastener, then opening 131 is also threaded and sized and dimensioned to receive the threaded fastener to affix light source holder 107 and base 113. Thus, it is also contemplated that base 113 also comprises an opening, such that insertion of fastener 121 through the opening of base 113 and opening 131 affixes light source holder 107 to a surface of base 113.

Figure 2A:
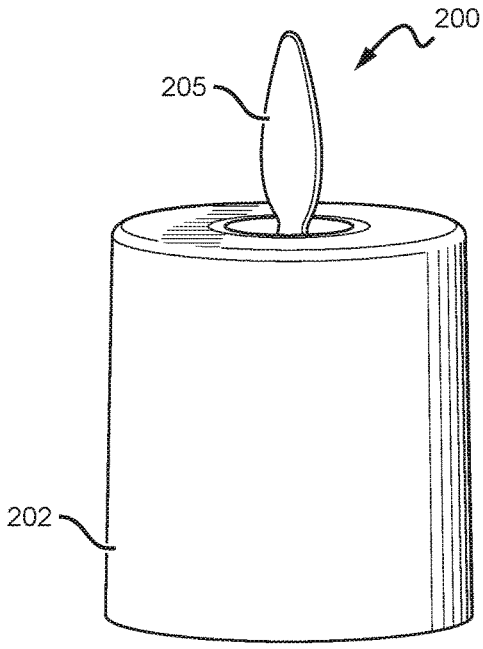
FIG. 2A is a perspective view of an embodiment of an electronic lighting device.

FIG. 2A shows another embodiment of an electronic lighting device 200 having an outer cover 202. A flame element 205 extends from a top of electronic lighting device 200, and is allowed to move in a manner that simulates a moving flame of a real candle. Similar to electronic lighting device 100, flame element 205 is preferably partially housed within the cover 202 and extends through an aperture 203 on an upper surface of outer cover 202 as shown in FIG. 2B. It should be appreciated that with respect to similarly-numbered components (e.g., housings 101 and housing 201, flame elements 105 and 205, etc.) between the embodiments described herein, it is contemplated that the properties and characteristics described in one embodiment are applicable in any of the other embodiments.

Flame element 205 is preferably suspended on housing 201 by a support member and allowed to move to simulate movement of a real candle light. As described above, a circuit board can control a drive mechanism of flame element 205, which could be an electromagnet, a fan, or other component that creates kinetic motion on flame element 205 to simulate the movement of a moving flame. A detailed description of a flame element and a housing can be found in U.S. patent application Ser. No. 14/819,146 and PCT International Application No. PCT/US2015/011642, which are hereby incorporated by reference.

A light source holder 207 is disposed within housing 201 and coupled to a base 213, which here comprises a PCB but could be a cover or other component. It is contemplated that light source holder 207 and base 213 are coupled by a fastener 221. Light source holder 207 is configured to receive a light source 211 and lens 209. Light source 211 and lens 209 can be aligned by light source holder 207 to emit light onto flame element 205 to mimic a real candle light. As shown in FIG. 2B, light source 211 can be directly affixed to base 213, such that light source holder 207 does not support light source 211. In such embodiments, it is contemplated that light source holder 207 can align light source 211 to emit light onto flame element 205. Alternatively, light source 211 can be supported by light source holder 207, such that light source 211 is indirectly affixed to base 213.

It should be appreciated that lens 209 can be used can be used to focus light emitted from light source 211. As discussed above, it is contemplated that light source 211 can project different colors of light, though preferably it projects a color that is similar to the color of a candle flame (e.g., orange, yellow, red, blue, or some combination thereof). Lens 209 can be used to focus the light to a desired degree by varying the focal length of the light emitted from light source 211.

Electronic lighting device 200 further comprises a battery compartment 204 that is sized and dimensioned to receive a power source (e.g., a disposable battery or a rechargeable battery). Additionally, or alternatively, it is contemplated that electronic lighting device 200 can receive power from an external power source. Power through electronic lighting device 200 is controlled by an on/off switch 208. However, it is also contemplated that electronic lighting device 200 can be controlled remotely by use of an infrared receiver 206.

Figure 2C:
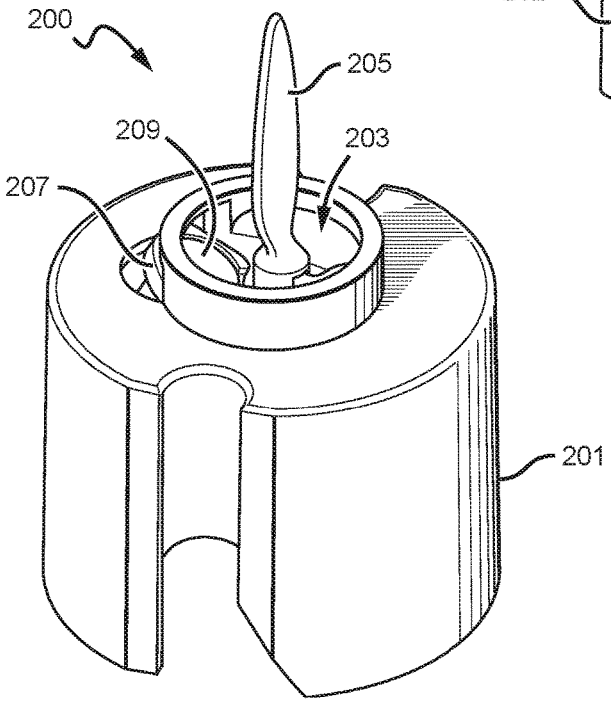
FIG. 2C is a perspective view of the housing, light source holder, flame element and other components of the electronic lighting device of FIG. 2A.
Figure 2B:
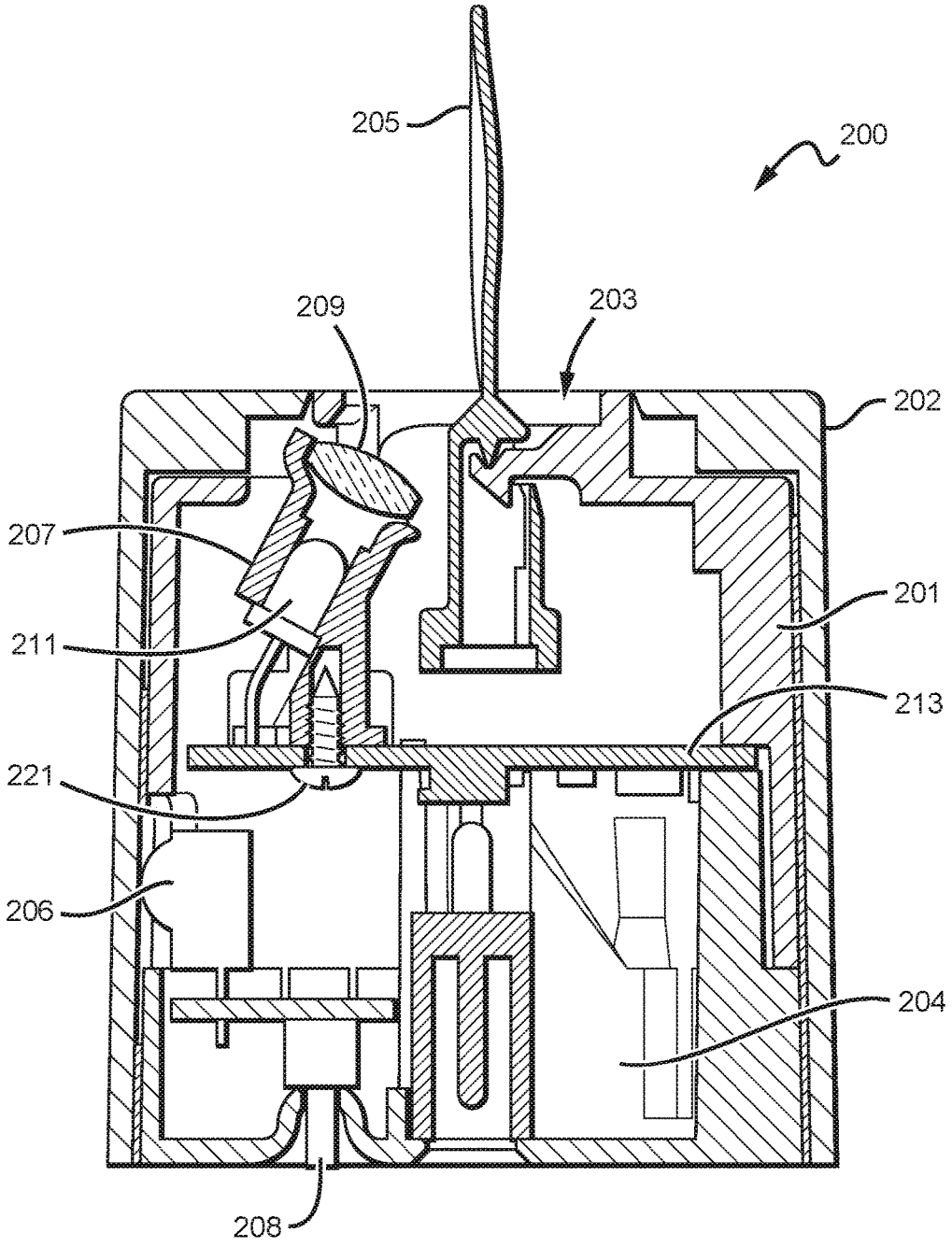
FIG. 2B is a cross-sectional view of the electronic lighting device of FIG. 2A.
Figure 2D:
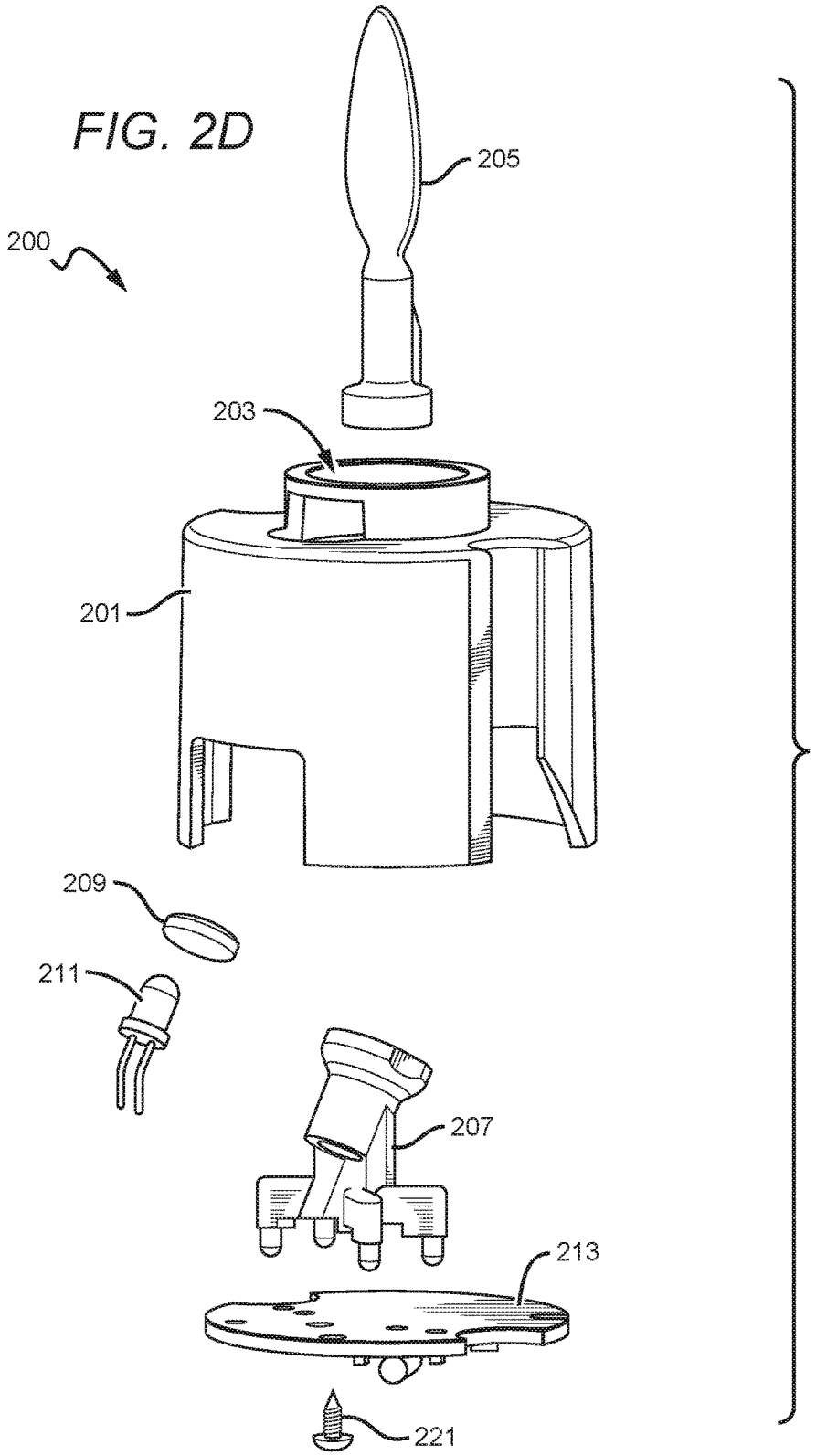
FIG. 2D is an exploded view of the housing, light source holder, flame element and other components of FIG. 2C.
Figure 2E:
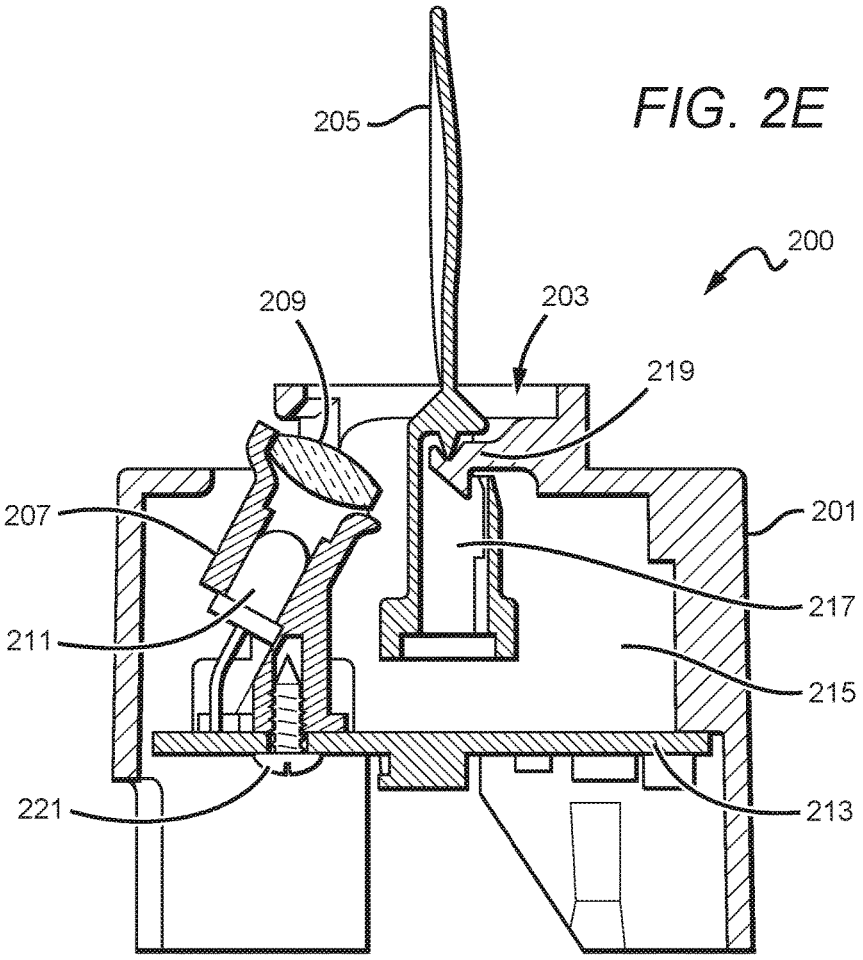
FIG. 2E is a cross-sectional view of the housing, light source holder, flame element and other components of FIG. 2C.
Figure 2F:
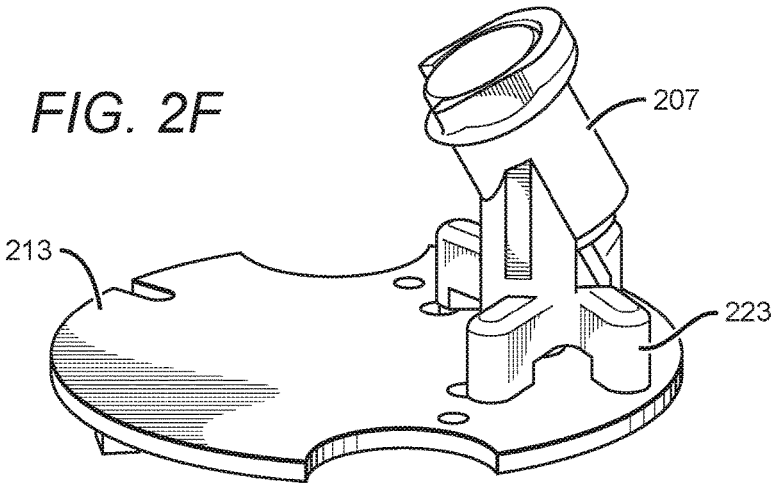
FIG. 2F is a perspective view of a light source holder and a base of the electronic lighting device of FIG. 2A.

Additional views of housing 201, light source holder 207, flame element 205 and other components of electronic lighting device are shown in FIGS. 2C-2E. Housing 201 comprises an internal cavity 215 and an aperture 203 disposed on an upper surface. A support member 219 extends towards the center of housing 201 and is coupled to flame element 205. It is contemplated that support member 219 can be removably coupled with housing 201.

Flame element 205 can comprise a hollow interior 217 and an aperture on a sidewall. Support member 219 can extend into the aperture and hollow interior 217 to suspend flame element 205, such that flame element 205 can move with respect to support member 219 to mimic movement of a real candle light. It is contemplated that flame element 205 can comprise a downward projection on an apex of hollow interior 217 that rests on a recess of support member 219. In other embodiments, support member 219 can comprise a rigid wire that extends through a through hole in flame element 205 to suspend flame element 205.

Where base 213 comprises a PCB, it should be appreciated that the PCB can be used to control various functions in electronic lighting device 100, including, but not limited to, movement of flame element 105, powering of light source 211, manipulating color of light source 211, and so forth. Light source holder 207 can be affixed to the PCB, such that light source holder 207 maintains light source 211 and lens 209 at a predefined focal length when light source holder 207 is affixed to the PCB. It should be appreciated that light source holder 207 can be disposed within electronic lighting device 200, such that light source holder 207 is entirely supported by the PCB and not by housing 201. In other words, in some embodiments, light source holder 207 is not directly coupled with housing 201. Additionally, or alternatively, light source 211 can be directly affixed to the PCB, such that light source holder 207 does not support light source 211. In other embodiments, it is contemplated that light source 211 is supported by light source holder 207, such that light source 211 is indirectly affixed to the PCB.

FIGS. 2F-2G shows perspective views of light source holder 207 affixed to base 213 (and PCB). Light source holder 207 comprises a plurality of legs 223 that extend outwardly from a center of light source holder 207. Each of the legs 223 may comprise a downwardly extending peg 224 that are sized and dimensioned to extend into apertures of base 213 to affix light source holder 207 to base 213. Additionally, or alternatively, base 213 can comprise recesses or pockets that are sized and dimensioned to receive downwardly extending peg 224.

The pegs 224 advantageously ensure the light source holder is properly positioned and oriented within the housing 201, and thereby ensures the light source and lens are also properly positioned and oriented. Where the light source is supported by the light source holder 207, the light source holder ensures the light source is not only disposed at a fixed distance from the lens, but also is oriented at the preferred angle and position to emit light on to the flame element 205. Additionally, or alternatively, fastener 221 extends through base 213 and light source holder 207 to affix base 213 and light source holder 207.

Light source holder 207 comprises an elongated stem 227 that extends vertically and comprises a first end and a second end as shown in FIGS. 2H-2J. An elongated, inclined cylinder 228 is disposed on the first end, and the inclined cylinder 228 comprises a first aperture 225 sized and dimensioned to receive light source 211. A plurality of legs 223 extend outwardly from elongated stem 227 near the second end.

Inclined cylinder 228 is typically angled relative to elongated stem 227. It is contemplated that inclined cylinder 228 and elongated stem 227 form an angle between 120 and 175 degrees, and more typically, between 145 and 175 degrees. It should be appreciated that inclined cylinder 228 is angled with respect to elongated stem 227 in an amount sufficient to align light source 211 and lens 209 with flame element 205.

As shown in FIGS. 2I-2J, light source holder 207 comprises four legs 223, each with a downwardly-extending peg 224. However, it is contemplated that light source holder 207 can comprise fewer or more legs 223. Each of legs 223 extend away from elongated stem 227 and form an "L"-letter shape. Typically, each leg 223 extends perpendicular to elongated stem 227. However, it is contemplated that legs 223 and elongated stem 227 can form other angles and shapes. Thus, legs 223 can be used to stabilize light source holder 207 and light source 211 against base 213, such that the angle and position of light source 211 is maintained with respect to flame element 205 and housing 201.

Viewed from another perspective, it is contemplated that base 213 comprises a first surface having apertures, and that each peg 224 extends at least partially through one of the apertures when light source holder 207 is affixed to base 213. In some embodiments, the first surface comprises the PCB, pegs 224 can extend through apertures on the PCB when light source holder 207 is affixed to the PCB.

An opening 229 is disposed on the second end of elongated stem 227. It is contemplated that opening 229 is sized and dimensioned to receive fastener 221. Additionally, or alternatively, a first surface of base 213 can comprise a second opening, such that insertion of fastener 221 through the second opening of base 213 and into opening 229 affixes light source holder 207 to the first surface of base 213 (see FIGS. 2F-2G). In a preferred embodiment, light source holder 207 is attached to base 213 with a single fastener 221, and four legs 223 are spread evenly around elongated stem 227 to provide stability to light source holder 207 on base 213. Thus, light source holder 207 can be configured to receive light source 211 in an inclined position with respect to the first surface of base 213.

It is contemplated that light source holder 207 could be attached with any material or mechanism suitable for stabilizing light source holder 207 onto base 213, and it is further contemplated that there could be any number of legs 223. Legs 223 preferably have flat bottoms that lay against base 213 and each leg 223 can have a small pin protrusion or peg 224 that can fit in an aperture of base 213 and/or a PCB to provide more stability. It is contemplated that the legs 223 and elongated stem 227, and the rest of light source holder 207 can be manufactured as a single piece via injection molding. By creating light source holder 207 as a single piece, the overall complexity of manufacturing light source holder 207 is significantly reduced. For example, the complexity in producing light source holder 207 is decreased by reducing the number of required parts and simplifying assembly (e.g., by robotic or human assembly lines).

In other aspects, it is contemplated that the housing comprises two apertures. A flame element extends through the first aperture from the internal cavity of the housing. A light source holder can align a light source and lens to emit light onto the flame element through a second aperture. It is contemplated that the apertures can be of any suitable shape and size to allow the light source, the flame element, or both to come through from the inner cavity of the housing.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements. Moreover, and unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

It should be apparent, however, to those skilled in the art that many more modifications besides those already described are possible without departing from the inventive concepts herein. The inventive subject matter, therefore, is not to be restricted except in the spirit of the disclosure. Moreover, in interpreting the disclosure all terms should be interpreted in the broadest possible manner consistent with the context. In particular the terms "comprises" and "comprising" should be interpreted as referring to the elements, components, or steps in a non-exclusive manner, indicating that the referenced elements, components, or steps can be present, or utilized, or combined with other elements, components, or steps that are not expressly referenced.

What is claimed is:

1. An electric lighting device, comprising:

a housing comprising an internal cavity and an aperture on an upper surface;

a printed circuit board (PCB) disposed within the housing;

a light source holder affixed to the PCB, such that the light source holder extends upwardly from the PCB and is disposed within the internal cavity; and wherein the light source holder is configured to receive a light source and lens in an inclined position with respect to the housing, such that light from the light source is emitted through the aperture.

2. The lighting device of claim 1, wherein the light source holder comprises a first aperture sized and dimensioned to receive a light source, and wherein the light source holder supports the light source within the housing.

3. The lighting device of claim 1, wherein the light source is affixed to the PCB in an inclined position, and wherein the light source holder is configured to at least partially encompass the light source when the light source is inserted into the light source holder.

4. The lighting device of claim 3, wherein the light source holder is further configured to maintain a predefined focal length between the lens and the light source when the light source holder is affixed to the PCB.

5. The lighting device of claim 1, further comprising:

a flame element at least partially disposed within the internal cavity; and a support member coupled to the housing, and configured to support the flame element and allow for movement of the flame element with respect to the support member.

6. The lighting device of claim 5, wherein the flame element comprises a hollow interior and an aperture disposed on a sidewall of the flame element, and wherein the support member extends outwardly toward the aperture, and wherein the support member is sized and dimensioned to extend into the aperture on the sidewall to suspend the flame element within the internal cavity and allow the flame element to move with respect to the support member.

7. The lighting device of claim 1, wherein the light source holder further comprises:

a base having at least three outwardly extending legs;

an elongated stem that extends vertically from the base and terminates with an elongated, inclined cylinder having a first end and a second end; and wherein the elongated, inclined cylinder comprises an aperture at each of the first and second ends, and wherein the aperture at the first end is sized and dimensioned to receive the light source.

8. The lighting device of claim 7, wherein the PCB comprises a first surface having at least three apertures, and wherein each of the at least three legs comprises a downwardly-extending peg that is configured to extend at least partially through one of the at least three apertures when the light source holder is affixed to the PCB.

9. The lighting device of claim 8, wherein the light source holder comprises an opening disposed on the second end and the opening is configured to receive a fastener, and wherein the first surface comprises a second opening, such that insertion of the fastener through the second opening into the opening affixes the light source holder to the first surface.

10. The lighting device of claim 1, wherein the light source holder further comprises:

an elongated stem that extends vertically from a base of the light source holder;

an elongated, inclined cylinder disposed on the elongated stem, wherein the cylinder comprises a first aperture sized and dimensioned to receive the light source; and an opening disposed on the base, wherein the opening is sized and dimensioned to receive a fastener.

11. The lighting device of claim 10, wherein the base comprises a first surface having a second opening, such that insertion of the fastener through the second opening into the opening affixes the light source holder to the first surface.

12. The lighting device of claim 1, wherein the light source holder is further configured to maintain a predefined focal length between the lens and the light source when the light source holder is affixed to the base.

13. The lighting device of claim 1, wherein the light source comprises a light-emitting diode (LED).

14. An electric lighting device, comprising:

a first surface comprising at least three apertures;

a light source support affixed to the first surface and having an elongated stem extending away from the first surface;

wherein the light source support further comprises at least three legs extending outwardly from the elongated stem and wherein each of the legs comprises a downwardly extending peg that is configured to be inserted into one of the at least three apertures when the light source support is affixed to the first surface; and wherein the light source support is configured to receive a light source in an inclined position with respect to the first surface.

15. The lighting device of claim 14, wherein the first surface comprises a PCB.

16. The lighting device of claim 14, wherein the elongated stem terminates at a first end opposite of the first surface, and wherein the first end comprises a first aperture having an inclined, cylindrical opening sized and dimensioned to receive the light source.

17. The lighting device of claim 14, wherein the light source is affixed to the first surface in an inclined position, and wherein the light source support is configured to at least partially encompass the light source when the light source is inserted into the light source support.

18. The lighting device of claim 14, wherein the light source support is further configured to receive a lens, and maintain a predefined focal length between the lens and the light source when the light source is inserted into the light source support.

19. The lighting device of claim 14, wherein the elongated stem of the light source support comprises an opening configured to receive a fastener, and wherein the first surface comprises a second opening, such that insertion of the fastener through the second opening into the opening affixes the light source support to the first surface.

20. The lighting device of claim 14, wherein the light source support is further configured to support and maintain the light source in the inclined position with respect to the first surface, and wherein the light source support is further configured to receive a lens, and maintain a predefined focal length between the lens and the light source when the light source is inserted into the light source support.

21. The lighting device of claim 14, further comprising:

a housing;

a support member coupled to the housing; and a flame element coupled to the support member, such that the flame element can move with respect to the support member.

22. The lighting device of claim 14, wherein the light source comprises a light-emitting diode (LED).

23. A support for a light source and lens of an electric lighting device, comprising:

a base having at least three outwardly extending legs, each with a downwardly extending peg;

an elongated stem that extends vertically from the base and terminates with an elongated, inclined cylinder having a first end and a second end;

wherein the elongated, inclined cylinder comprises an aperture at each of the first and second ends, and wherein the aperture at the first end is sized and dimensioned to receive a light source, and wherein the aperture at the second end is sized and dimensioned to receive a lens, such that the support maintains a predefined focal length between the lens and the light source; and wherein the base comprises a threaded opening configured to receive a fastener.

* * * * *